US006773378B2

(12) United States Patent
Bastyr et al.

(10) Patent No.: US 6,773,378 B2
(45) Date of Patent: Aug. 10, 2004

(54) EXERCISE DEVICE WITH TRUE PIVOT POINT

(75) Inventors: Charles A. Bastyr, Del Mar, CA (US); Stephen O. Ross, Oceanside, CA (US)

(73) Assignee: Steven O. Ross, Fallbrook, CA (US)

( * ) Notice: Subject to any disclaimer, the term of this patent is extended or adjusted under 35 U.S.C. 154(b) by 321 days.

(21) Appl. No.: 09/737,209

(22) Filed: Dec. 14, 2000

(65) Prior Publication Data

US 2002/0077227 A1 Jun. 20, 2002

(51) Int. Cl.[7] ..... A63B 21/015; A63B 21/012
(52) U.S. Cl. ..... 482/115; 482/114; 482/118
(58) Field of Search ..... 482/114–115, 118, 482/116–117, 121–126, 127, 428, 49

(56) References Cited

U.S. PATENT DOCUMENTS

| | | | | | |
|---|---|---|---|---|---|
| 3,802,701 | A | | 4/1974 | Good, Jr. | |
| 4,374,588 | A | | 2/1983 | Ruggles | |
| 4,385,760 | A | * | 5/1983 | Mattox et al. | 482/114 |
| 4,436,303 | A | | 3/1984 | McKillip | |
| 4,618,139 | A | * | 10/1986 | Haaheim | 482/70 |
| 4,684,126 | A | | 8/1987 | Dalebout | |
| 4,850,585 | A | | 7/1989 | Dalebout | |
| 5,013,034 | A | | 5/1991 | March | |
| 5,037,088 | A | * | 8/1991 | Bernstein | 482/112 |
| 5,042,799 | A | | 8/1991 | Stanley | |
| 5,062,633 | A | | 11/1991 | Engel | |
| 5,158,519 | A | | 10/1992 | Hughes | |
| 5,167,596 | A | | 12/1992 | Ferber | |
| 5,244,446 | A | | 9/1993 | Engel | |
| 5,445,581 | A | * | 8/1995 | Ferber | 482/46 |
| 5,454,769 | A | | 10/1995 | Chen | |
| 5,460,586 | A | | 10/1995 | Wilkinson | |
| 5,954,621 | A | * | 9/1999 | Joutras et al. | 482/114 |
| 6,244,988 | B1 | * | 6/2001 | Delman | 482/8 |
| 6,436,058 | B1 | * | 8/2002 | Krahner et al. | 600/587 |

* cited by examiner

*Primary Examiner*—Nicholas D. Lucchesi
*Assistant Examiner*—Fenn C. Mathew
(74) *Attorney, Agent, or Firm*—Nydegger & Associates

(57) ABSTRACT

An exercise device with a true pivot point includes a first and a second arm joined at a joint assembly. The first arm is fixed in relation to the joint assembly and is also stabilized at an end opposite the joint assembly. The second arm rotates in a first, or in a second direction, about an axis of rotation which is defined by the joint assembly. A resistance mechanism is contained in the joint assembly which includes a one-way clutch interconnected to the second arm to allow the second arm to rotate freely in a second direction. Rotation by the second arm in a first direction, however, engages the resistance mechanism to create a resistance to the first rotation.

14 Claims, 5 Drawing Sheets

EXERCISE DEVICE WITH TRUE PIVOT POINT

FIELD OF THE INVENTION

The present invention pertains generally to physical exercise devices. More specifically, the present invention pertains to portable exercise devices and methods for using these devices. The present invention is particularly, but not exclusively, useful as an adjustable exercise device which allows the individual user to selectively stabilize the device during an exercise routine.

BACKGROUND OF THE INVENTION

As is well known, a wide variety of exercise equipment is commercially available for purchase and use by individuals for purposes of developing their overall strength and physical condition. Often this equipment is designed for specific purposes, such as for exercising targeted muscle groups. The more complex and comprehensive the exercises become, however, it often happens that the exercise equipment also becomes more complex, more bulky, and less mobile. Similarly, exercise equipment that is designed for multiple exercises and for exercising multiple muscles becomes more complex, bulky and less mobile.

In general, exercise equipment can be categorized as being either stationary equipment or portable equipment. Typically, stationary equipment is found in gyms, athletic facilities, training centers, and to a lesser degree in homes, and involves floor-mounted frames that normally incorporate heavy weights or other force generating mechanisms. An important reason for using stationary exercise equipment is that such equipment adds an element of stability to an exercise routine and provides a means for reacting forces being applied by the user to the equipment. In many exercise routines, and particularly those that are designed for physical therapy purposes, this element of stability may be very desirable. For instance, whenever there is a targeted muscle group, it may be important to insure that the muscle group is properly exercised. This means the exercise routine should involve repetitively consistent muscle contractions against a resistance of predictable magnitude and direction. To achieve these objectives, it is necessary to somehow stabilize the equipment. This is easily done with stationary equipment. By definition, however, stationary equipment is not portable and requires a dedicated area for its location.

The use of portable exercise equipment has several advantages. One such advantage is availability. The convenience of being able to carry the equipment from site to site can be of considerable value to a user. This value can be significantly increased if the equipment itself is relatively lightweight and easy to handle. Further, as implied above in the context of stationary equipment, the versatility of portable exercise equipment can be significantly increased if it is somehow capable of being stabilized so that it is possible to reliably and consistently perform the repetitions of an exercise routine and be used at physiologically significant load levels. It is a further advantage if the portable exercise equipment can be quickly, easily, and conveniently configured for use when initiating an exercise session, and for performing a variety of exercise routines.

In light of the above, it is an object of the present invention to provide a portable exercise device which can be stabilized during an exercise routine. Another object of the present invention is to provide an exercise device which includes an adjustable mechanism that will reliably and repeatedly provide a desired resistance to the user during an exercise routine. Another object of the present invention is to provide an exercise device that can be easily and quickly configured by the user to perform a variety of exercises. Another object of the present invention is to provide an exercise device that can be used for exercising various muscles within the body of the user. Another object of the present invention is to provide an exercise device that does not interfere with or constrain normal joint biomechanics during the user's performance of exercise routines with the device. Another object of the present invention is to provide an exercise device for use by an individual which is compact, portable, and safe. Yet another object of the present invention is to provide an exercise device which is relatively simple to manufacture, is easy to use and is comparatively cost effective.

Other objects, features and advantages of the present invention will become apparent from the following description, taken in conjunction with the accompanying drawings, which illustrate, by way of example, the principle of the invention.

SUMMARY OF THE PREFERRED EMBODIMENTS

A portable exercise device in accordance with the present invention includes a first arm, a second arm and a joint assembly that interconnects the first arm with the second arm. For reference purposes, the joint assembly defines an axis of rotation that is substantially perpendicular to both the first arm and the second arm. Within this assembly, the first arm can be considered as having a fixed relationship with respect to the axis. On the other hand, the second arm is able to rotate about the axis. More specifically, the second arm is able to rotate freely in one direction around the axis, while being restrained by a resistance during a rotation in the opposite direction.

Included in the joint assembly is a one-way clutch that is fixed to a cone member. A shaft that is fixed to the second arm is positioned within the one-way clutch. Through the action of the one-way clutch, the cone member moves together with the second arm when the second arm is moved in one direction, but it does not move with the second arm when the second arm is moved in the opposite direction. Also included in the joint assembly, along with the cone member, are a cup member and a friction liner. More specifically, both the cone member and the cup member have tapered surfaces that conform to each other, and the friction liner is positioned between these surfaces at their interface. Further, the cup member is connected directly to the first arm. An alternate embodiment is envisioned for the present invention which will not employ the one-way clutch. In this embodiment the cone member will move with the second arm in both directions.

In the operation of the portable exercise device, the first arm is preferably stabilized in some manner by the user. With the first arm stabilized, the second arm will rotate freely about the axis in the direction wherein the one-way clutch does not engage movement of the second arm. Specifically, the shaft rotates freely within the one-way clutch. On the other hand, when the second arm is moved in the opposite direction, i.e. the direction wherein the one-way clutch fixedly engages with the second arm by way of the shaft, the second arm will encounter resistance. Specifically, when the one-way clutch becomes engaged, the tapered surface of the cone member will move relative to the tapered surface of the cup member. This movement will involve the friction liner and will generate a force that resists the rotation and is substantially constant throughout the movement. It will be appreciated by the skilled artisan that whenever there is no relative movement between the arms, i.e. when the second arm is stationary relative to the first arm, there is zero stored energy in the exercise device.

Several alternate embodiments are envisioned for the present invention which will respectively use different mechanisms for generating a one-way or two-way resistance to the relative movement between the second arm and the first arm. Specifically, a spring or an elastomeric material can be positioned in the joint assembly and oriented to resist any relative movement of the second arm in a predetermined direction of rotation. Further, pneumatic, hydraulic, viscous shear, magnetic or electromagnetic systems can be used for this purpose.

In the preferred embodiment of the present invention, control over the amount of the resistance there is to a rotation of the second arm, relative to the first arm, is accomplished at the joint assembly. Specifically, for this purpose the joint assembly includes a knob which is mounted on the cup member. This knob has a threaded connection with a plunger so that rotations of the knob will cause a translational movement of the plunger. The plunger, in turn, is in contact with a spring which is compressed or allowed to elongate with rotations of the knob, and this spring interacts with the cone member. Thus, in combination, a rotation of the knob activates the spring to urge the tapered surface of the cone member against the friction liner on the tapered surface of the cup member. Accordingly, depending on the direction the knob is rotated, the resistance to rotation between the cup member and cone member can be increased or decreased. There may also be a spring-loaded detent that is mounted on the cup member so that when the knob is turned, the detent is urged against detent notches in the knob to provide an aural signal in response to the rotation of the knob.

It is an important aspect of the present invention that the device can be stabilized as the second arm of the device is rotated against the resistance created by the resistance mechanism. To do this, the first arm can include a stabilizing mechanism that is located at the end of the first arm opposite the joint assembly. Preferably, this stabilizing mechanism is a foot pedal. Alternatively, however, the stabilizing mechanism may be a friction surface, a mounting bracket, a handle, or some other suitable stabilizing element.

The second arm can include an input mechanism that is located at the end of the second arm opposite the joint assembly. Preferably, this mechanism is a handle that can be placed in a variety of positions.

The present invention also envisions that a position sensor can be mounted on the device to monitor repetitions in an exercise routine. If used, the sensor can generate signals which represent changes in the relative positions of the arms of the device. These changes can then be timed and used to count repetitions or cycle duration that may be useful for monitoring the exercise routine. A computer or microprocessor interface can also be established to monitor the signals that are generated by the position sensor.

It is further envisioned that a load or strain sensor can be mounted on the device to monitor the load applied by the user of the device to rotate the second arm against the resistance created by the resistance mechanism. If used, the sensor can generate a signal that is proportional to the magnitude of force applied by the user of the device. This signal can be used to calculate the peak, average, and minimum load applied by the user in each exercise cycle. The signal can also be monitored and timed to count repetitions or cycle duration. A computer or microprocessor interface can also be established to monitor the signals that are generated by the load or strain sensor, and to calculate and display other useful exercise information.

During an exercise routine, the exercise device of the present invention can be used by an individual to perform, for example, biceps exercises. To do this, the individual sets the resistance according to his or her strength and exercise goals. Once the resistance is set, the individual user then stabilizes the first arm of the device by stepping on the foot pedal. While positioning the elbow in close alignment with the axis of rotation of the joint assembly, the individual can then grasp the handle that is attached to the extended end of the second arm. The second arm can then be rotated in a clockwise or a counterclockwise rotation about the joint assembly. In one scenario, a clockwise rotation produces resistance as the targeted muscles contract. During a counterclockwise rotation, however, the resistance is released, and the second arm can be returned to its initial position. For subsequent exercise routines, the resistance can be increased as the muscles become stronger. Further, the device can be easily and quickly reconfigured to change the direction of resistance or to change to other configurations so that the user can alter body positions or alter the relationship of the device relative to the user for other exercise routines and for exercising other muscles.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENT

Figure 1:
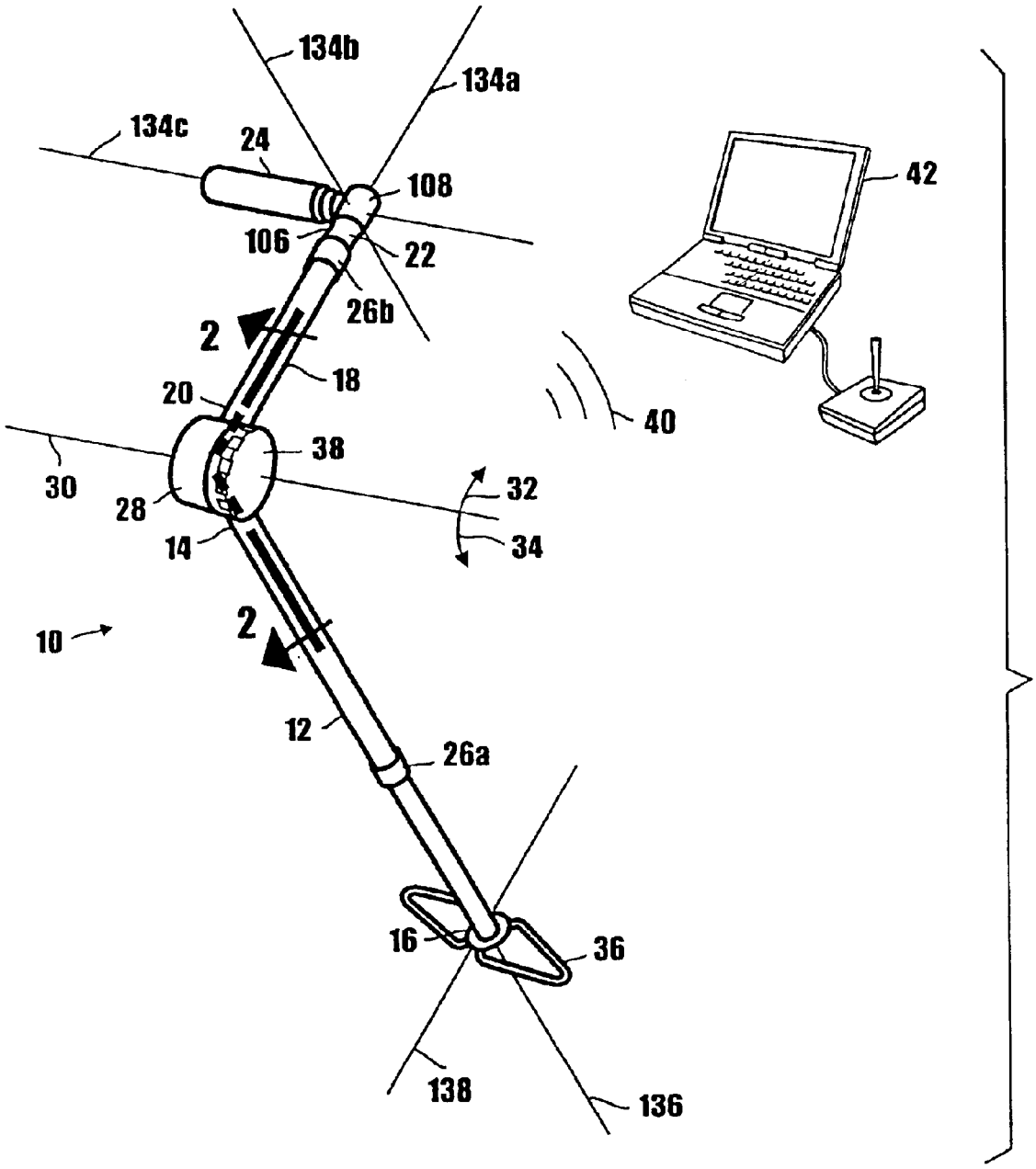
FIG. 1 is a perspective view of the exercise device of the present invention shown with peripheral computer equipment.

An exercise device in accordance with the present invention is shown in FIG. 1 and is generally designated 10. As shown, the device 10 includes a first arm 12, which has a first end 14 and a second end 16. The device 10 also has a second arm 18 which has a first end 20 and a second end 22. As shown in FIG. 1, the second arm 18 has a handle 24 that is attached at its second end 22. It is to be appreciated, however, that the handle 24 can be pivoted about the end 22 through an arc of approximately one hundred and eighty degrees so that the handle 24 extends from the arm 18 in a direction opposite to that shown in FIG. 1. Additionally, both the first arm 12 and the second arm 18 have respective locking rings 26*a* and 26*b* that can be manipulated in a manner well known in the art to telescopically adjust the respective lengths of the arms 12 and 18.

FIG. 1 also shows that the device 10 includes a joint assembly 28 which, for reference purposes, defines an axis of rotation 30. In their relationship to this axis of rotation 30, the first arm 12 is attached to the joint assembly 28 to establish a fixed relationship between the first arm 12 and the axis of rotation 30. On the other hand, the second arm 18 is pivotally attached to the joint assembly 28 for a reciprocal rotation of the second arm 18 about the axis of rotation 30. More specifically, this rotation of the second arm 18 about the axis of rotation 30 can be in either a clockwise direction 32 or in a counterclockwise direction 34. It is to be appreciated that the second arm 18 as shown in FIG. 1 can be rotated to other positions about the axis of rotation 30 to establish alternate exercise configurations of the device 10.

For a preferred embodiment of the device 10, at least one foot pedal 36 can be attached to the second end 16 of the first arm 12 such that the foot pedal 36 can rotate about axis 138 or an axis substantially parallel to and in close approximation to axis 138. During use of device 10, the foot pedal 36 is placed at a position located approximately ninety degrees relative to arm 12. However, this angle can vary during use of device 10 to accommodate normal biomechanical motions. For storage, the foot pedal 36 can be rotated to a position next to arm 12, substantially parallel to axis 136. It is also envisioned that a position sensor 38 can be mounted on the device 10, possibly at the joint assembly 28, to generate signals 40 that are representative of the relative positions of said first arm 12 and said second arm 18 of the device 10. Specifically, these signals 40 can be generated in a manner well known in the pertinent art and transmitted to a remote computer 42 or other electronic monitoring device for processing. More specifically, the signals 40 can be used to indicate the position of the first arm 12 relative to the second arm 18, and to measure the time duration between changes in the relative positions of said first arm 12 and said second arm 18 of the device 10. It is further envisioned that a load sensor 106, such as a strain gauge, can be mounted on the device 10, possibly near handle 24, to generate signals 40 that are representative of the loads that are applied to the handle 24 of device 10. These signals 40 also can be generated in a manner well known in the pertinent art and transmitted to a remote computer 42 or other electronic monitoring device for processing and displaying useful information regarding exercise sessions. Thus, exercise repetitions, the duration of each repetition, and the load applied by the user 90 (FIG. 5A) during each repetition in an exercise routine can be monitored. Furthermore, other exercise performance information and data can be determined from the signals 40.

Figure 2:
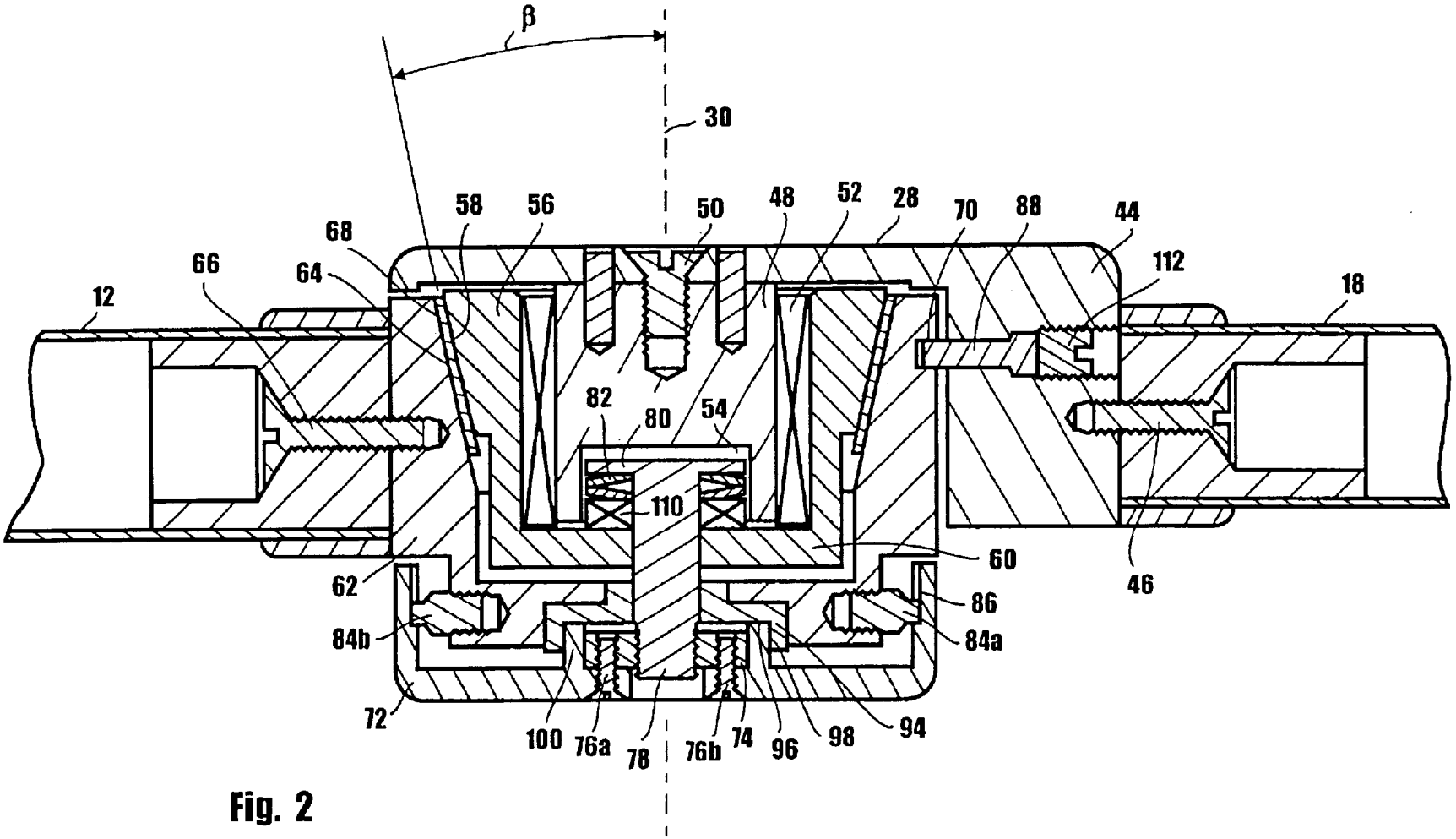
FIG. 2 is a cross sectional view of the joint assembly of the exercise device of the present invention as would be seen along a line 2—2 in FIG. 1 when the device is straightened.

Turning now to FIG. 2, the resistance mechanism that is incorporated into the joint assembly 28 of the device 10 is shown in detail. There it can be seen that the arm 18 is connected to an extension member 44 by means, such as the screw 46, and that the extension member 44 is connected to a shaft 48 by means, such as the screw 50. As shown, the shaft 48 is centered on the axis of rotation 30. Further, the resistance mechanism includes a circular one-way clutch 52, of a type well known in the pertinent art. The one-way clutch 52 may also have an integral bearing assembly. In a preferred embodiment, the one-way clutch is a Torrington Type DC Roller Clutch and Bearing Assembly, part number RCB-162117. Those of ordinary skill in the art will understand, however, that the one-way clutch 52 may comprise a variety of suitable devices. The one-way clutch 52 is also centered on the axis of rotation 30 and the shaft 48 is formed with a recess 54.

A cone member 56 is included in the joint assembly 28 and is positioned against the one-way clutch 52. As shown in the preferred embodiment, this cone member 56 is formed with a tapered surface 58 that surrounds the axis of rotation 30 and is angled relative to the axis of rotation 30 at angle $\beta$. In a preferred embodiment, angle $\beta$ is between ten and fifteen degrees. However, those of ordinary skill in the art will understand that there are many suitable values for angle $\beta$ including ninety degrees, in which case tapered surface 58 will be substantially perpendicular to the axis of rotation 30. Additionally, the cone member 56 includes a rim 60 that is oriented radially on the axis of rotation 30. This rim 60 projects over the recess 54 of the shaft 48 substantially as shown. Also included in the joint assembly 28 is a cup member 62 which has a tapered surface 64, and which is attached directly to the arm 12 by means such as the screw 66. Importantly, the tapered surface 64 of the cup member 62 is dimensioned to mate with the tapered surface 58 of the cone member 56. As intended for the device 10, a friction liner 68 is positioned between the respective tapered surfaces 58 and 64 of the cone member 56 and the cup member 62. Preferably, the friction liner 68 is fixed to either the cone member 56 or the cup member 62. Also, the cup member 62 is formed with an annular groove 70 that is substantially centered on the axis of rotation 30.

Still referring to FIG. 2, it is seen that the joint assembly 28 includes a knob 72 that is connected to a threaded ring 74 by means such as the screws 76*a* and 76*b*. Further, the ring 74 is threadably engaged with a plunger 78. As shown, the plunger 78 is formed with a flange 80 that is inserted into the recess 54 of the shaft 48. Additionally, a force transfer mechanism, such as a spring 82, and a thrust bearing 110 are positioned in the recess 54 between the flange 80 of plunger 78 and the rim 60 of cone member 56. The relative position of spring 82 and thrust bearing 110 is interchangeable. In a preferred embodiment, spring 82 is two Berg belleville washers, part number St-7, stacked in a parallel configuration, and thrust bearing 110 is a Torrington thrust needle roller and cage assembly, part number NTA-411 and two thrust washers, part number TRA-411. However, those of ordinary skill in the art will understand the spring 82 and the thrust bearing 110 may comprise a variety of suitable devices. A bushing 94 is mounted on the cup member 62 and is constrained from rotating about the axis of rotation 30 with respect to cup member 62 by means well known by those of ordinary skill in the art. Flange 100 of the knob 72 is positioned against the bushing 94, and the knob 72 is constrained from translating along the axis of rotation 30 by radial surface 96 of bushing 94 and from moving in a radial direction relative to the axis of rotation 30 by the annular surface 98 of the bushing 94.

Figure 3:
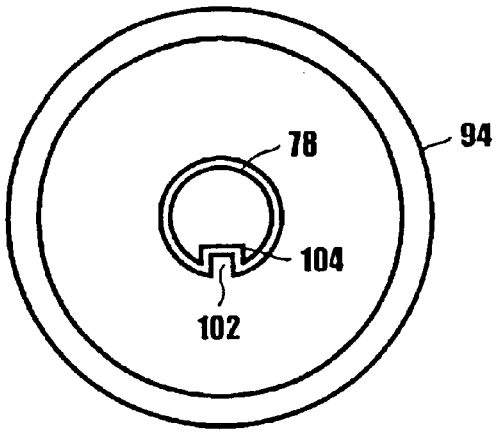
FIG. 3 is a plan view of the interconnection between the plunger and bushing of the joint assembly as seen looking along the axis of rotation shown in FIG. 2.

Turning to FIG. 3, it is seen that bushing 94 has a key 102 that protrudes into keyway 104 in plunger 78. The interaction of the key 102 with the keyway 104 prevent the plunger 78 from rotating with respect to the bushing 94 and limits its motion to translation along the axis of rotation 30.

Referring again to FIG. 2, a plurality of spring-loaded detents 84, of which the detents 84*a* and 84*b* are only exemplary, can be mounted on the cup member 62 to urge against the knob 72. Further, the knob 72 can be formed with a plurality of recesses 86 so that as the knob 72 is rotated, the spring-loaded detents 84 will come into contact with the recesses 86 and thereby make an aural "clicking" sound. The contact of the detents 84 with the recesses 86 also provides incremental rotational setting of the knob 72 wherein there is a slight resistance to rotation of the knob 72 at each of these settings. As an additional matter, it is to be noted that a guide pin 88 is mounted on the extension member 44 and is inserted into the annular groove 70. Thus, a rotation of the arm 18 around the axis of rotation 30 will be controlled by the interaction of the guide pin 88 in the groove 70, preventing arm 18, extension member 44 and shaft 48 from translating along the axis of rotation 30 relative to the cup member 62. The guide pin 88 is held in position by set screw 112.

In the operation of the device 10, a user 90 will first adjust the exercise resistance that is to be provided by the joint assembly 28. Specifically, this is accomplished by rotating the knob 72. With reference to FIG. 2, it will be appreciated by a skilled artisan that a rotation of the knob 72 causes the threaded ring 74 to interact with the plunger 78 in a way that will effect a translational movement of the plunger 78. Accordingly, depending on the direction that knob 72 is rotated, the plunger 78 will either advance into the recess 54 or be withdrawn from the recess 54. The consequence of this is that the force transfer mechanism (spring 82) will be respectively relaxed or compressed between the flange 80 of plunger 78 and the rim 60 of cone member 56. In either case, the force that is generated by the spring 82 will act against the cone member 56. Importantly, this force will be effectively transferred through the cone member 56 to establish a reactive force on the friction liner 68 at the interface between the tapered surface 58 of the cone member 56 and the tapered surface 64 of the cup member 62. Furthermore, utilizing a force transfer mechanism (spring 82) allows the knob 72 to be rotated through larger angles in adjusting the exercise resistance from its lowest setting to its highest setting than would be possible if a force transfer mechanism was not employed.

Through the action of the one-way clutch 52, the arm 18 and its extension member 44 are able to freely rotate about the axis of rotation 30 when the arm 18 is rotated in a predetermined direction, e.g. the clockwise direction 32. On the other hand, the one-way clutch 52 will fixedly engage the arm 18 with the cone member 56 when the arm 18 and its extension member 44 are rotated in the opposite direction, e.g. the counterclockwise direction 34. As a consequence, when the arm 18 is fixedly engaged with the cone member 56 through the one-way clutch 52, the rotation of the arm 18 will encounter the resistance that is established on the friction liner 68 between the cone member 56 and the cup member 62. As indicated above, the amount of this resistance is established by rotating the knob 72. Importantly, through the action of key 102 and thrust bearing 110, plunger 78 and knob 72 are prevented from rotating when the action of the one-way clutch 52 causes cone 56 to rotate with respect to cup 62 as arm 18 is rotated. Further, the audible "clicks" that result when the detents 84*a,b* pass over recesses 86, together with a visible gauge (not shown), can be used for determining preferred resistance levels.

Figure 4:
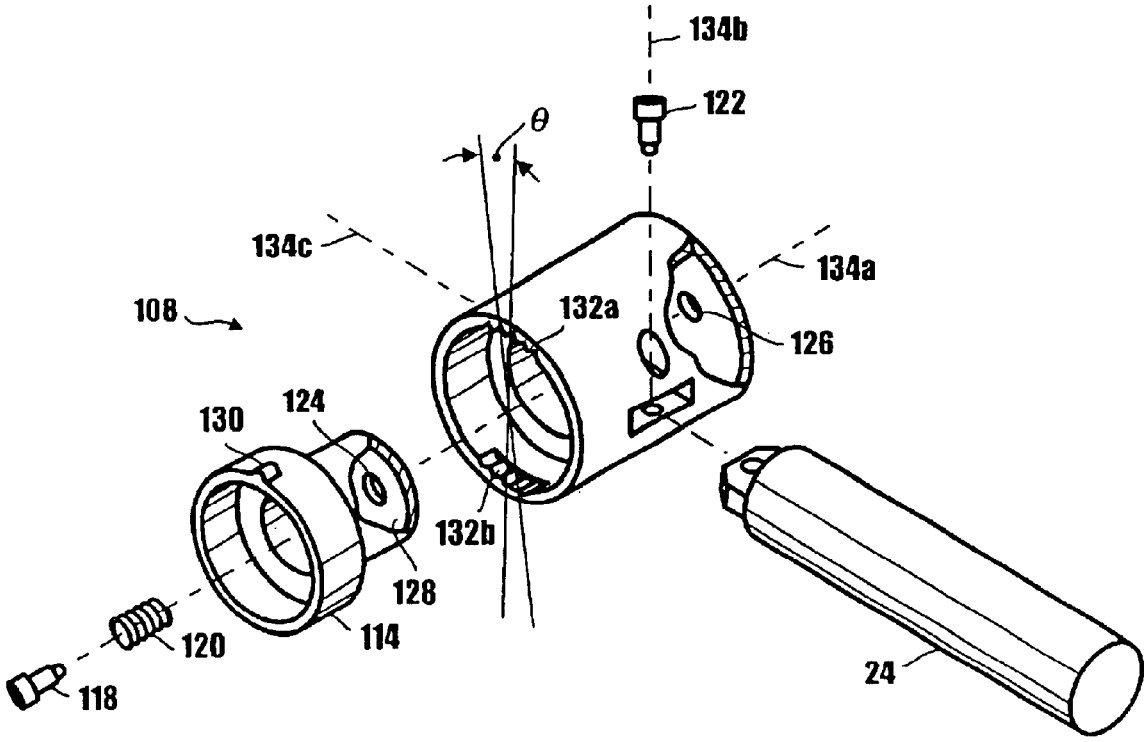
FIG. 4 is an exploded view of a handle assembly.

Turning now to FIG. 4, the handle assembly 108 of device 10 is shown in detail. There it can be seen that the handle 24 is connected to the outer hub 116 by means such as the shoulder screw 122. As shown, the shoulder screw 122 is centered on the axis 134*b*. The handle 24 is free to rotate about the axis 134*b*, out of alignment with axis 134*c*, approximately thirty degrees in a clockwise direction and a counterclockwise direction. A plurality of notches 132*a* and a plurality of notches 132*b* are formed on the inside circumference of outer hub 116. The notches 132*a* are oriented at angle θ with respect to each other. Likewise, the notches 132*b* are oriented at angle θ with respect to each other. In a preferred embodiment, angle θ is equal to ten degrees. The notches 132*a* and 132*b* are oriented one hundred and eighty degrees with respect to each other about axis 134*a*. Inner hub 114 has at least one key 130 formed on its outer circumference. The key 130 is dimensioned to mate with the notches 132*a* and the notches 132*b*. The inner hub 114 fits within the outer hub 116 such that the key 130 fits securely within one of the notches 132*a* or one of the notches 132*b*.

The inner hub 114 is attached to the outer hub 116 by the shoulder screw 118 and the spring 120. The shoulder screw 118 passes through the spring 120 and through the hole 124 in inner hub 114 and threads into the hole 126 in the outer hub 116. As shown, the screw 118 and the spring 120 are centered on the axis 134*a*. The spring 120 is constrained between the head of shoulder screw 118 and the inner surface 128 of the inner hub 114, biasing inner hub 114 within outer hub 116.

To configure the handle assembly 108 for an exercise routine, the outer hub 116 is translated relative to the inner hub 114 along axis 134*a*, compressing the spring 120 to a position where key 130 is clear of the notches 132*a* and the notches 132*b*. In this position, the outer hub 116 can be rotated about axis 134*a* to a position where key 130 will align with any of the plurality of notches 132*a* or the plurality of notches 132*b*. In a preferred embodiment, one of the notches 132*a* and one of the notches 132*b* are oriented on the inside circumference of the outer hub 116 such that the handle 24 will be aligned with axis 134*c* when the key 130 engages either of these notches. The inner hub 114 is attached to end 22 of arm 18 by means well known by those skilled in the art.

Importantly, the ability of the handle 24 to freely rotate about axis 134*b*, and to be selectively and fixedly positioned about axis 134*a*, allows device 10 to be configured for the correct anatomical position and biomechanical motion of the hand, wrist and joints of the user 90, both before and during an exercise routine cycle.

Figure 5A:
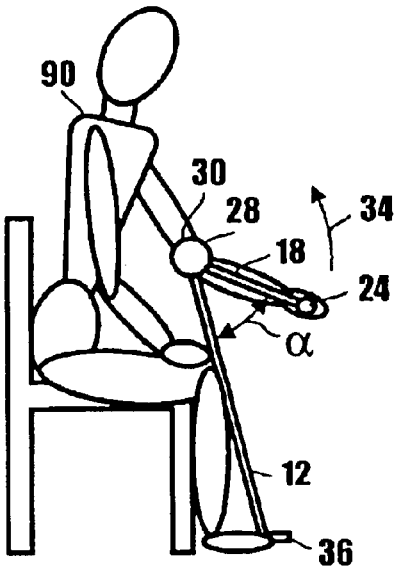
FIG. 5A is a side elevation view of a user with the exercise device positioned with the joint assembly at the elbow (joint being exercised) and with the user's arm extended.
Figure 5B:
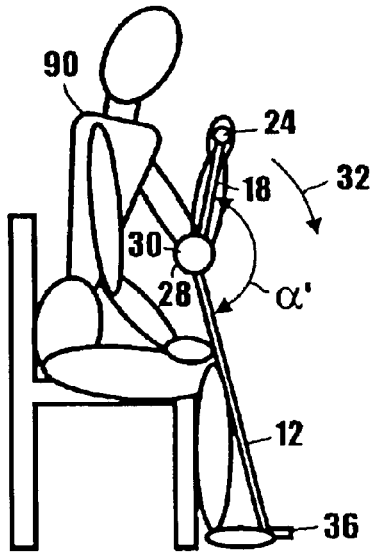
FIG. 5B is a side elevation view of a user with the exercise device positioned with the joint assembly at the elbow (joint being exercised) and with the user's arm flexed.

FIGS. 5A and 5B show an exemplary use of the device 10 wherein the axis of rotation 30 is positioned close to the axis of rotation of the joint of the user 90 that is to be flexed and extended during an exercise routine. In this example, the elbow of the user 90. The device 10 is stabilized by the user 90 by stepping on the foot pedal 36. Rotation of the handle 24 by the user 90 in a counterclockwise direction 34 (FIG. 5A) will be met by a resistance force generated by the joint assembly 28 as the arm 18 is rotated about the axis of rotation 30. Conversely, rotation of the handle 24 by the user 90 in a clockwise direction 32 (FIG. 5B) will meet no resistance from the joint assembly 28 as the arm 18 is rotated about the axis of rotation 30. Further, the direction in which the resistance force acts can be reversed by first rotating the device 10 approximately one hundred and eighty degrees about axis 136 (FIG. 1) and then, if needed, rotating the handle 24 about the axis of rotation 30 or the axis 134*a* to place the handle 24 in the desired position for the exercise to be performed. The arms 12 and 18 can be lengthened or shortened to effect other exercises.

Figure 6A:
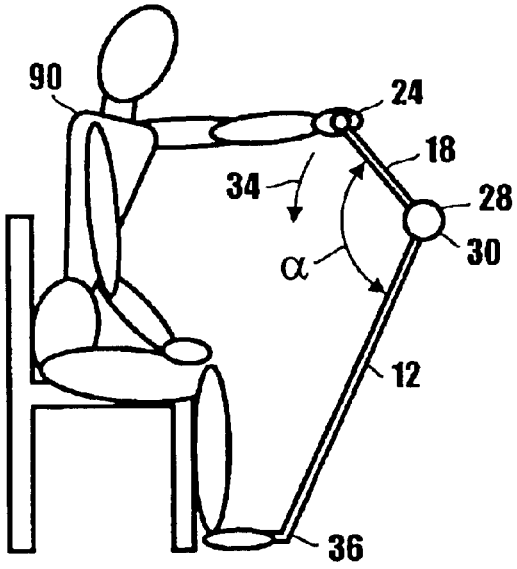
FIG. 6A is a side elevation view of a user with the exercise device positioned with the joint assembly remotely positioned and with the user's arm elevated.
Figure 6B:
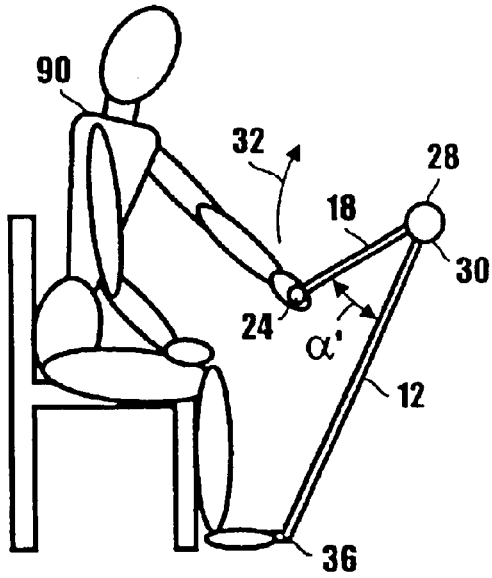
FIG. 6B is a side elevation view of a user with the exercise device positioned with the joint assembly remotely positioned and with the user's arm lowered.

FIGS. 6A and 6B show a use of the device 10 wherein the axis of rotation 30 on the device 10 is positioned at a distance from the axis of rotation of the joint of the user 90 that is to be flexed and extended during the exercise routine. In this example, the shoulder of the user 90.

Figure 7A:
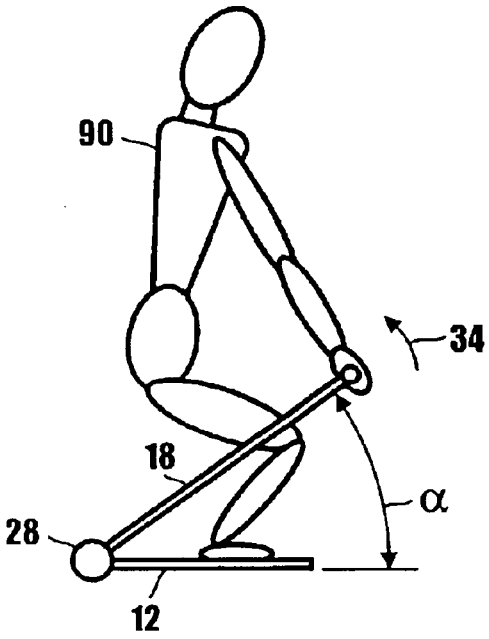
FIG. 7A is a side view representation of a user operating the exercise device of the present invention with rotation in one direction.
Figure 7B:
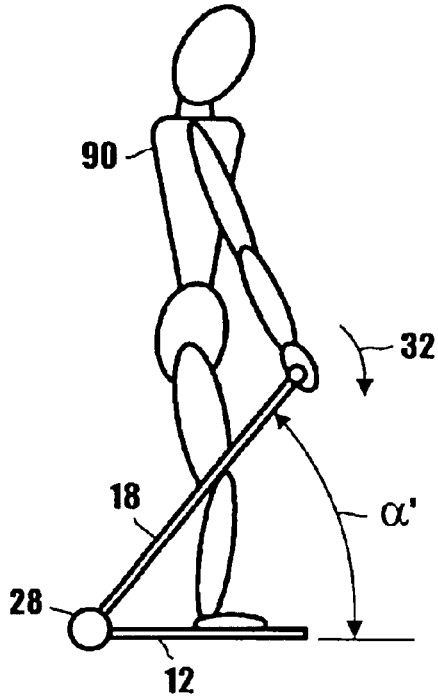
FIG. 7B is a side view representation of the user operating the exercise device with a rotation in an opposite direction.
Figure 8:
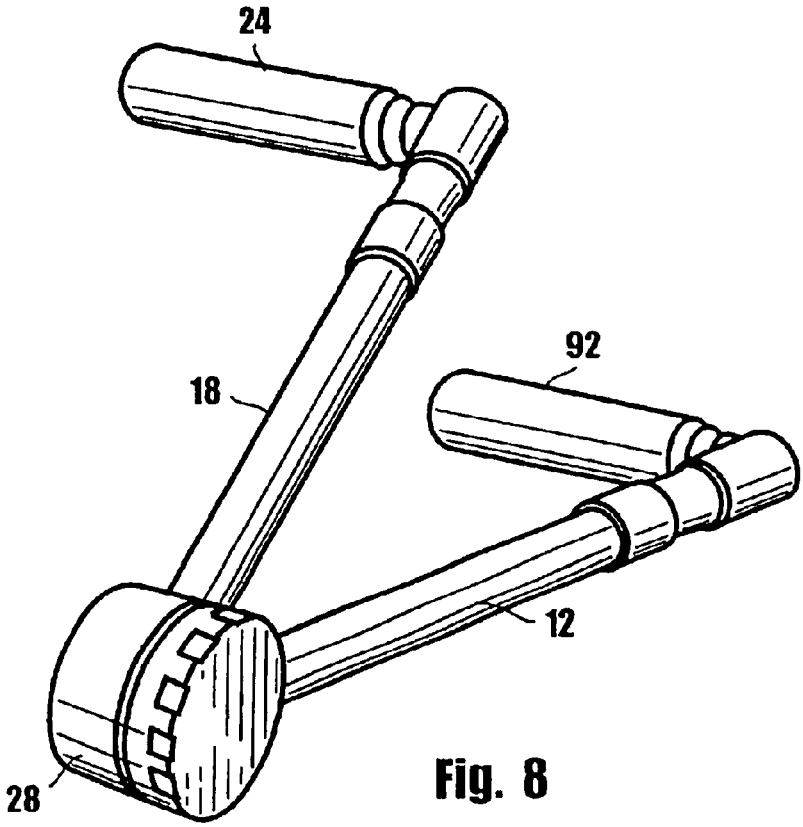
FIG. 8 is a perspective view of an alternate embodiment of the exercise device of the present invention.

FIGS. 7A and 7B show that as an alternative to stabilizing the device 10 by stepping on the foot pedal 36, the user 90 can otherwise stabilize the device 10 by stepping on the arm 12. Then, for example, movements of the user 90 from a leaning position (FIG. 7A) to a standing position (FIG. 7B) can be met by a resistance force. Specifically, this resistance force will be generated by the joint assembly 28 as the arm 18 is rotated about the axis of rotation 30 in the direction 34. Conversely, movements of the user 90 from the standing position (FIG. 7B) to the leaning position (FIG. 7A) will meet no resistance from the joint assembly 28 as the arm 18 is rotated about the axis of rotation 30 in the direction 32. Additionally, in an alternate embodiment of the device 10 shown in FIG. 8, the foot pedal 36 can be replaced by a handle 92. Regardless which embodiment of the device 10 is contemplated, the position sensor 38 can be used to monitor or guide the exercise routine of the user 90. For example, in addition to the signals 40 containing time information data, the signals 40 can also convey information about the relative positions of said first arm 12 and said second arm 18 of the device 10. Thus, returning to FIGS. 5A and 5B, the signals 40 can include information on the angle $\alpha$ between the arm 12 and the arm 18 (FIG. 5A), and changes in this angle $\alpha$ to the angle $\alpha'$ (FIG. 5B). Furthermore, the load sensor 106, either in combination with the position sensor 38 or alone, can be used with any of the embodiments of the device 10 to monitor or guide the exercise routine of the user 90. The signals 40 can also contain data regarding the magnitude of the force applied by the user 90 to the device 10 to overcome the resistance force generated by the joint assembly 28 as the arm 18 is rotated from a position at angle $\alpha$, from arm 12 (FIG. 5A) to a position at angle $\alpha'$ from arm 12 (FIG. 5B). Additionally, the signals 40 can contain data regarding the magnitude and relative direction of the force applied by the user 90 of the device 10 in returning the arm 18 from angle $\alpha'$ to angle $\alpha$. Such information and data, of course, can be useful for monitoring both the duration and the extent of exercise routines conducted with the device 10 as well as the magnitude of the loads applied to the device 10 by the user 90 during the exercise routines. This information and data can also be used by the computer 42 or other electronic monitoring devices to perform calculations and analysis of the exercise routines.

While the particular exercise device with true pivot point as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. An exercise device which comprises:

a first arm having first end and a second end;

a second arm having a first end and a second end;

a joint assembly defining an axis of rotation, said first end of said first arm being attached to said joint assembly to establish a fixed relationship between said first arm and said axis, with said first end of said second arm being pivotally attached to said joint assembly for rotation of said second arm about said axis in a first direction and in a second direction;

a means attached to said second end of said first arm for stabilization of said second end of said first arm during a movement of said second arm about said axis of rotation;

a shaft mounted on said joint assembly and fixedly interconnected with said second arm;

a one-way clutch engageable with said shaft;

a cone member engaged with said one-way clutch for free rotation of said second arm relative to said cone member around said axis in said second direction, and for rotation of said second arm with said cone member around said axis in said first direction, said cone member having a surface;

a cup member fixedly attached to said first arm, said cup member having a surface dimensioned for a mating engagement with said surface of said cone member at an interface there between to establish said resistance to said rotation of said second arm, and wherein said cup member is formed with an annular groove, said groove being centered on said axis of rotation and lying in a plane substantially perpendicular thereto;

a guide pin, said guide pin being mounted on said second arm for insertion into said groove to interconnect said second arm with said joint assembly;

a plunger;

a force transfer mechanism positioned between said plunger and said cone member;

a knob mounted on said cup member and connected to said plunger, said knob being rotatable to selectively move said plunger relative to said cone member to activate said force transfer mechanism and urge said surface of said cone member against said surface of said cup member to establish said resistance; and a plurality of spring-loaded detents, said spring-loaded detents being mounted on said cup member to urge against said knob to provide an aural signal in response to rotation of said knob.

2. An exercise device as recited in claim 1 wherein said surface of said cone member is tapered, and wherein said surface of said cup member is tapered.

3. An exercise device as recited in claim 1 wherein said force transfer mechanism comprises:

a spring; and a thrust bearing to allow relative motion between said plunger and said cone member.

4. An exercise device as recited in claim 1 further comprising a friction liner positioned at said interface between said surface of said cone member and said surface of said cup member.

5. An exercise device as recited in claim 1 wherein said stabilizing means is a foot pedal.

6. An exercise device as recited in claim 1 further comprising a handle attached to said second end of said second arm.

7. An exercise device as recited in claim 6 wherein said handle can be selectively oriented relative to said second arm.

8. An exercise device as recited in claim 1 further comprising:

a load sensor mounted on said device to generate signals representative of the magnitude of said resistance to said rotation of said second arm; and a means for monitoring said signals.

9. An exercise device for use by a person which comprises:

a first arm having a first end and a second end;

a second arm having a first end and a second end;

a joint assembly defining an axis of rotation, said first end of said first arm being attached to said joint assembly to establish a fixed relationship between said first arm and said axis, with said first end of said second arm being pivotally attached to said joint assembly for rotation of said second arm about said axis in a first direction and in a second direction;

a one-way clutch mounted on said joint assembly to interconnect said clutch with said second arm;

a means attached to said second end of said first arm for stabilization of said second end of said first arm during a movement of said second arm about said axis of rotation;

a cone member engaged with said one-way clutch for free rotation of said second arm relative to said cone member around said axis in said second direction, and for rotation of said second arm with said cone member around said axis in said first direction, said cone member having a surface;

a cup member fixedly attached to said first arm, said cup member having a surface dimensioned for a mating engagement with said surface of said cone member at an interface therebetween to establish a resistance to said rotation of said second arm, and wherein said cup member is formed with an annular groove, said groove being centered on said axis of rotation and lying in a plane substantially perpendicular thereto;

a means for interconnecting said second arm with said joint assembly;

a plunger;

a force transfer mechanism having a spring positioned between said plunger and said cone member; and a knob mounted on said cup member and connected to said plunger, said knob being rotatable to selectively move said plunger relative to said cone member to activate said force transfer mechanism and urge said tapered surface of said cone member against said tapered surface of said cup member to establish said resistance.

10. An exercise device as recited in claim 9 further comprising a foot pedal attached to said second end of said first arm for stabilization of said first arm.

11. An exercise device as recited in claim 9 wherein said surface of said cone member is tapered, and wherein said surface of said cup member is tapered.

12. An exercise device as recited in claim 9 further comprising:

a position sensor mounted on said device to generate signals representative of relative positions of said first arm and said second arm for said device; and a means for monitoring said signals.

13. An exercise device as recited in claim 9 further comprising a friction liner positioned at said interface between said surface of said cone member and said surface of said cup member.

14. An exercise device which comprises:

a first arm having first end and a second end;

a second arm having a first end and a second end;

a joint assembly defining an axis of rotation, said first end of said first arm being attached to said joint assembly to establish a fixed relationship between said first arm and said axis, with said first end of said second arm being pivotally attached to said joint assembly for rotation of said second arm about said axis in a first direction and in a second direction;

a one-way clutch mounted on said joint assembly to interconnect said clutch with said second arm;

a cone member engaged with said one-way clutch for free rotation of said second arm relative to said cone member around said axis in said second direction, and for rotation of said second arm with said cone member around said axis in said first direction, said cone member having a surface;

a cup member fixedly attached to said first arm, said cup member having a surface dimensioned or a mating engagement with said surface of said cone member at an interface therebetween to establish a resistance to said rotation of said second arm;

a plunger;

a spring positioned between said plunger and said cone member; and a knob mounted on said cup member and connected to said plunger, said knob being rotatable to selectively move said plunger relative to said cone member to activate said force transfer mechanism and urge said tapered surface of said cone member against said tapered surface of said cup member to establish said resistance.

* * * * *